US005127128A

United States Patent [19]

Lee

[11] Patent Number: 5,127,128

[45] Date of Patent: Jul. 7, 1992

[54] CLEANER HEAD

[75] Inventor: Young C. Lee, Songnam, Rep. of Korea

[73] Assignee: Goldstar Co., Ltd., Rep. of Korea

[21] Appl. No.: 557,413

[22] Filed: Jul. 23, 1990

[30] Foreign Application Priority Data

Jul. 27, 1989 [KR] Rep. of Korea ..... 10963/1989
Jul. 27, 1989 [KR] Rep. of Korea ..... 10967/1989

[51] Int. Cl.[5] ..... A47L 11/282; A47L 11/30

[52] U.S. Cl. ..... 15/322; 15/384; 15/385

[58] Field of Search ..... 15/321, 322, 384

[56] References Cited

U.S. PATENT DOCUMENTS 965,315 7/1910 Moorhead ..... 15/322
1,821,715 9/1931 Kuchinsky ..... 15/322
2,932,844 4/1960 O'Connor ..... 15/384 X
3,616,482 11/1971 Brycki ..... 15/322 X
3,992,747 11/1976 Hufton ..... 15/322 X
4,139,922 2/1979 Fitch ..... 15/321

*Primary Examiner*—Chris K. Moore
*Attorney, Agent, or Firm*—Anthony J. Casella; Gerald E. Hespos

[57] ABSTRACT

A cleaner head is disclosed which comprises: a cleaning fluid spraying nozzle formed at the center of the bottom of the cleaner head; a leading suction nozzle and a leading brush (or a leading portion of a brush); and a trailing brush (or a trailing portion of the brush) and a trailing suction nozzle. The leading suction nozzle sucks free dirt, and the leading brush (or the leading portion of the brush) performs dry scrubbing for free dirt and adhered solidified dirt. The trailing brush (or the trailing portion of the brush) performs wet scrubbing in cooperation with the sprayed cleaning fluid, and the trailing suction nozzle performs suction for the mixture of the dirt and cleaning fluid. According to the present invention, the cleaning can be done more thoroughly.

4 Claims, 5 Drawing Sheets

CLEANER HEAD

FIELD OF THE INVENTION

The present invention relates to a cleaner head which is capable of cleaning dirt, such as solidification of dust, water and oils accumulated on a floor, and particularly to a cleaner head which is improved such that it should be suitable for cleaning floors.

BACKGROUND OF THE INVENTION

As shown in FIGS. 1A, 1B, 1C and 1D, the conventional cleaning head attached to the conventional cleaners has structures which are intended to be suitable for cleaning dirt, such as solidification of dust, water and oils adhered on a floor. Such a cleaner includes a cleaning fluid source 1, a brush 4 and a suction source 2, while the cleaner head which performs the cleaning in contact with the floor includes: a cleaning fluid spraying nozzle 3 connected to the cleaning fluid source 1; and a suction nozzle 5 connected to both the brush 4 and the suction source 2, thereby forming an independent cleaner head 7.

In the conventional cleaner head constituted as above, if the cleaning fluid is sprayed over the floor through the cleaning fluid spraying nozzle 3, then the cleaning fluid functions such that the adhering forces of the dirt are weakened so as to become easy to remove. Thereafter, if the brush 4 is revolved by the driving power of a motor 6 (FIGS. 1B, 1C and 1D), or when the brush 4 is pushed or pulled by hand (FIG. 1A), the solidified dirt are separated from the floor, and are dissolved into the cleaning fluid, upon contact with the cleaning fluid.

Then, the dirt, which are removed from the floor and dissolved into the cleaning fluid are sucked through the suction nozzle 5.

However, such a conventional cleaner has no functions such as the function of removing relatively large solidified dirt before the spraying of the cleaning fluid, and the function of scraping out the hard dirt adhered on the floor.

Therefore, excessive loads are imposed on the brush 4 and on the suction nozzle 5, and the suction is liable to be incomplete, with the result that the residue dirt and the residue cleaning fluid adhere again to the floor.

Therefore, there remains the problem that a post finish cleaning has to be carried out. Further, the spraying of the cleaning fluid, the brushing and the suction have to be carried out in a sequential manner, and therefore, the cleaner can not be moved arbitrarily owing to its structural nature, with the result that the cleaning can be completely carried out only when the cleaning is done in a single particular direction.

Further, there is the problem that the cleaning fluid contaminated by the brush is flowed to the floor.

SUMMARY OF THE INVENTION

The present invention is intended to overcome the above described disadvantages of the conventional device.

Therefore, it is the object of the present invention to provide a cleaner head in which the cleaning efficiency is improved to the maximum by disposing the cleaning fluid spraying nozzle at the center of the cleaner head, and by disposing the brushes and the suction nozzles at the front and rear or at the left and right, or around the cleaner head.

BRIEF DESCRIPTION OF THE DRAWINGS

The above object and other advantages of the present invention will become more apparent by describing in detail the preferred embodiment of the present invention with reference to the attached drawings in which:

FIG. 3 illustrates different embodiments of the brush and the suction nozzle of the present invention in which:

DESCRIPTION OF THE PREFERRED EMBODIMENT

Figure 1A:
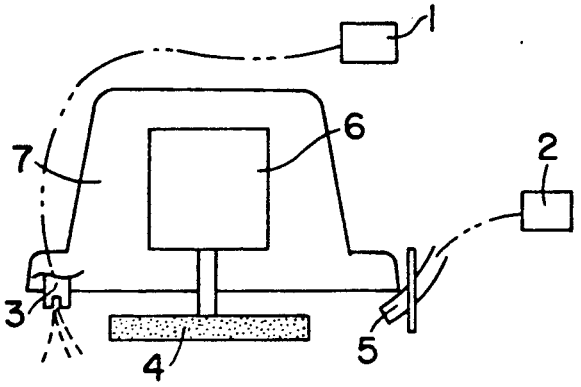
FIG. 1(A) PRIOR ART
FIGS. 1A, 1C and 1D illustrate the different structures of the conventional cleaner head.
Figure 1B:
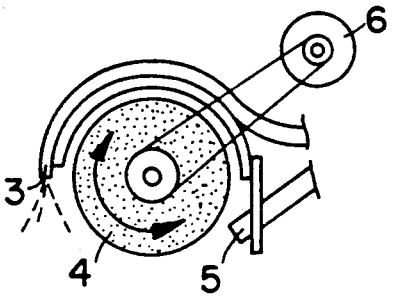
FIG. 1(B) PRIOR ART
Figure 1C:
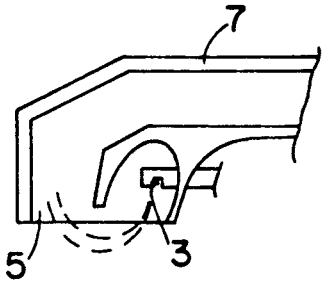
FIG. 1(C) PRIOR ART
Figure 1D:
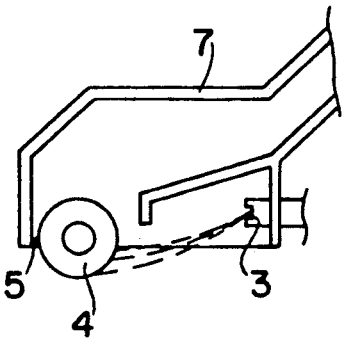
FIG. 1(D) PRIOR ART
Figure 2A:
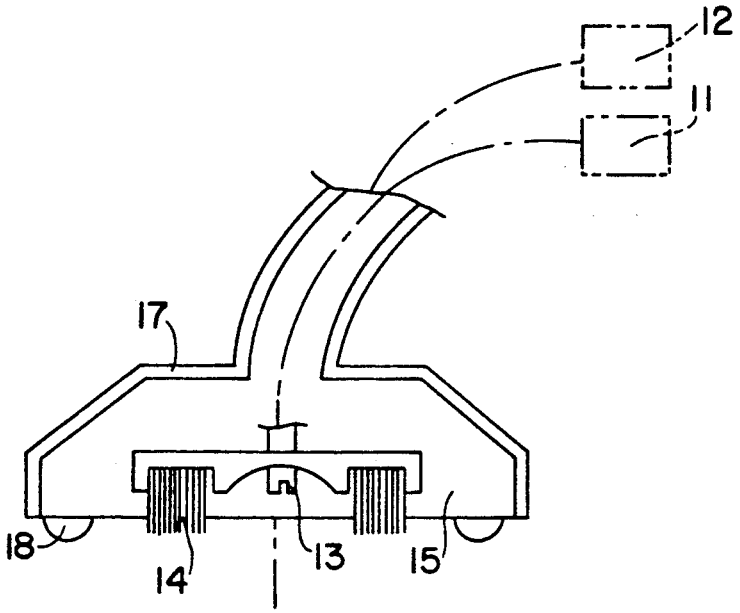
FIG. 2A is a sectional view of the cleaner head according to the present invention.
Figure 2B:
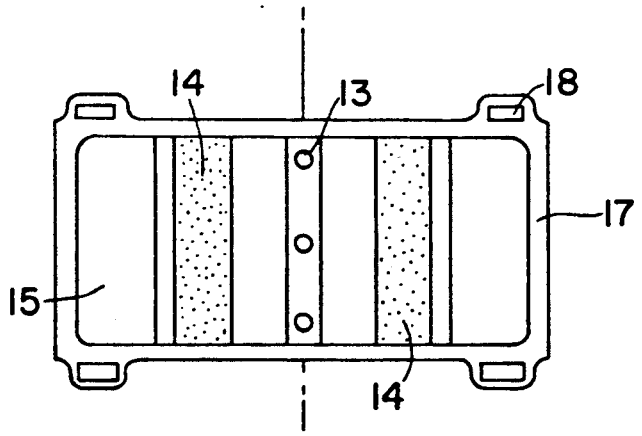
FIG. 2B is a bottom view of the cleaner head of the present invention.
Figure 3A:
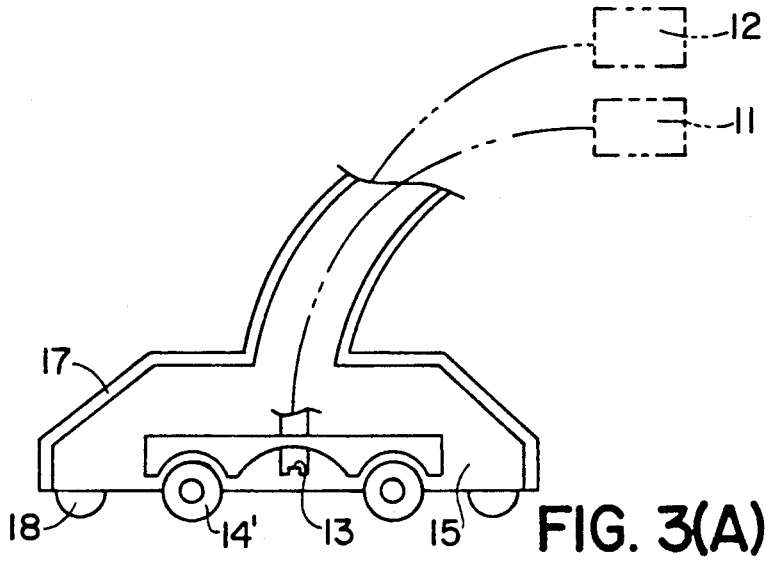
FIG. 3A is a sectional view of the brush which is rotatably installed.
Figure 3B:
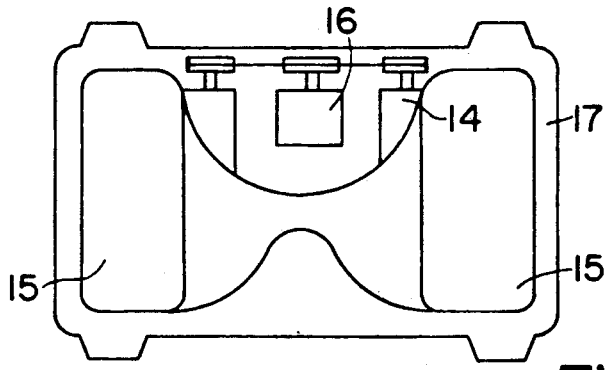
FIG. 3B is a schematical plan view of the brush of FIG. 3A.
Figure 3C:
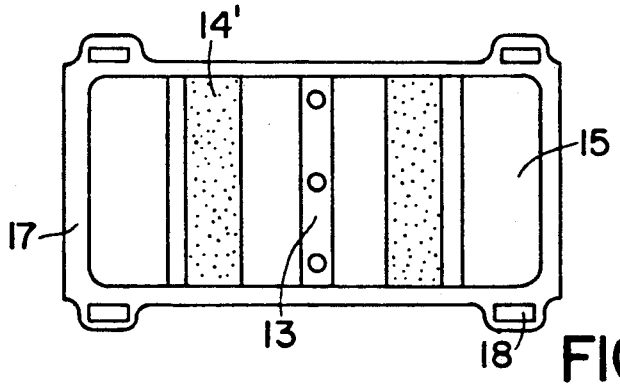
FIG. 3C is a bottom view of the brush of FIG. 3A.

As shown in FIG. 3, a body 17 includes a cleaning fluid spraying nozzle, a suction nozzle, and a brush. Further, the cleaner head according to the present invention is constituted such that: at the center of the body 17, there are formed a cleaning fluid spraying nozzle 13, with a conduit of the nozzle being connected to a cleaning fluid source 11; at the opposite sides of the nozzle 13, there are installed roller-shaped brushes 14 which are made of elastic thick fibers, and which are suitable for scraping out the solidified dirt adhered on the floor; adjacent to the brushes 14, there are formed suction nozzles 15 for sucking the mixture of dirt and the cleaning fluid; at four positions about the peripheries of the body of the cleaner head, there are installed four wheels 18 for arbitrarily moving the cleaner head on the floor; and a suction source 12 is connected to the body 17 of the cleaner head through a hose.

Figure 4A:
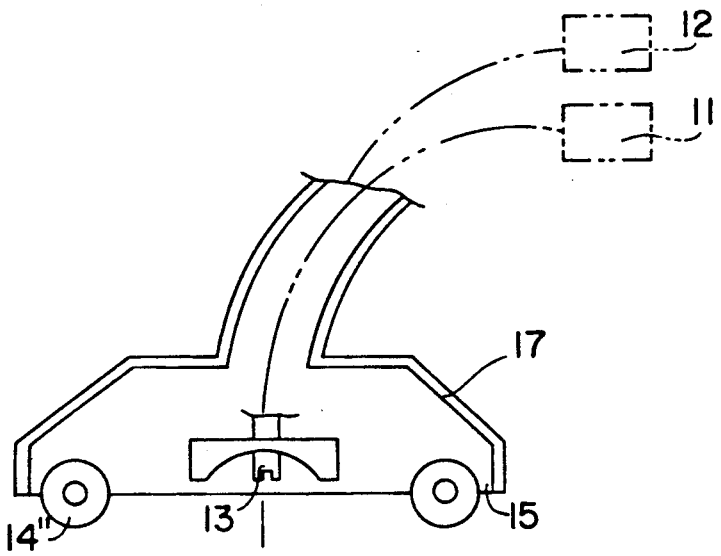
FIG. 4A is a sectional view showing the brush disposed closely near the mouth of the suction nozzle.
Figure 4B:
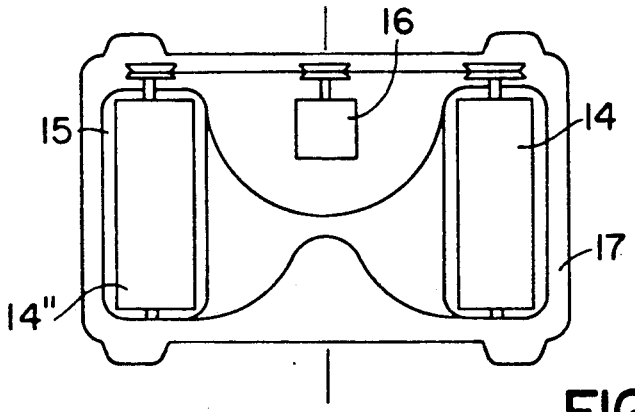
FIG. 4B is a schematical plan view of the brush of FIG. 4A.
Figure 4C:
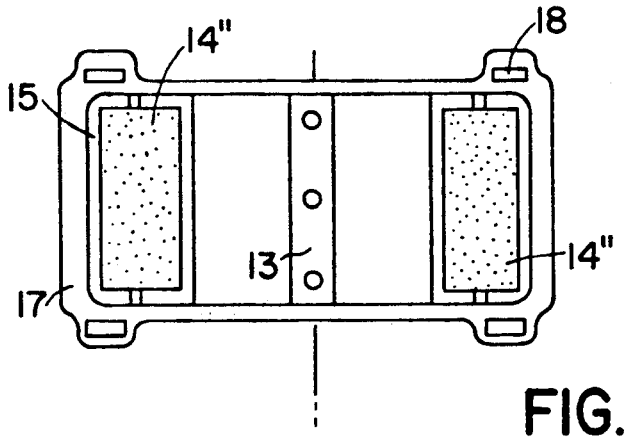
FIG. 4C is a frontal view of the brush of FIG. 4B.

The stiff fibers of the brushes 14' which are for separating the dirt in cooperation with the cleaning fluid are planted to cylindrical rotors, and theses brushes 14' are connected through belts to an electric motor, so that the brushes should revolve. In constituting the brushes in a rotatable form, the brushes 14'' can be disposed closely near the suction nozzles 15 as shown in FIG. 4.

Figure 5A:
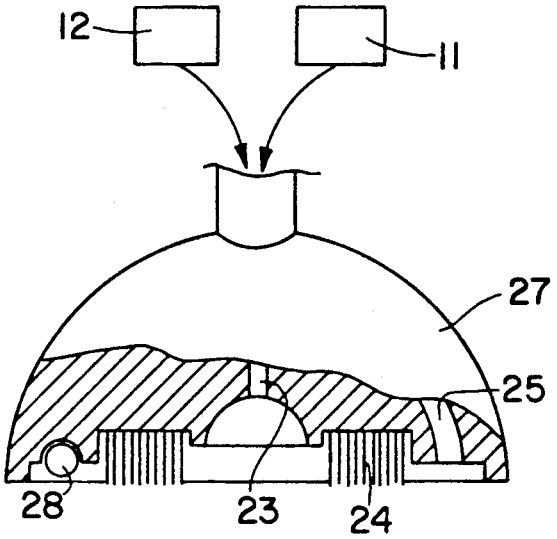
FIG. 5C is a sectional view showing the brush secured on a circular bottom of the cleaner head.
FIG. 5B is a bottom view of the state of FIG. 5A.
Figure 5B:
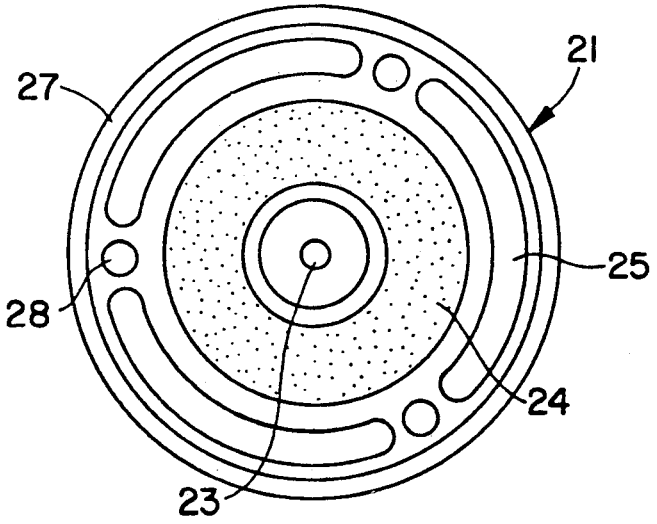

Further, the cleaner head can be constituted such that: the cleaning fluid spraying nozzles 13 are formed at the center of the body 17; and the brushes 14 are installed besides the nozzle 13; but as shown in FIG. 5, a brush 24 is installed concentrically with spray nozzles 23; suction nozzles 25 are also installed concentrically with the nozzle 23; four wheels 28 are provided in the form of balls so as for the body 27 to be arbitrarily moved in any direction; and washeres are provided in order to prevent the ball-shaped wheels from being detached.

In such a constitution, the cleaner head should preferably take a semi-spherical form, and the body 27 is connected to a suction source 12 and a cleaning fluid source 11.

The device of the present invention constituted as above will now be described as to its operations and effects. In operating the device of the present invention, a dry scrubbing is carried out after sweeping the floor, and the scrubbing is carried out in the order of a dry scrubbing, a wet scrubbing and a wet-dry sucking. To describe it more specifically, if the externally attached suction source 12 is activated, a negative pressure is generated in the suction nozzles. Owing to this negative pressure, the cleaning fluid of the cleaning fluid source 11 is spray-supplied through the cleaning fluid spraying nozzles 13 to the floor to be cleaned, after performing the sweeping which is the first operating step of the cleaning.

Under this condition, the cleaner head is arbitrarily moved over the floor by means of the wheels 18 installed on the body 17. Then, as the body 17 advances in the desired direction, there is carried out the dry scrubbing in which the leading suction nozzle 15 and the leading brush 14 are let to perform the function of sucking the free dirts and the function of scrubbing the adhered dirt.

The trailing suction nozzle 15 and the trailing brush 14 are let to perform the function of carrying out a wet scrubbing after the spraying of the cleaning fluid in order to detach the adhered solidified dirt from the floor, and the function of sucking the mixture of the detached dirt and the cleaning fluid.

Meanwhile, the body 17 of the cleaner head is capable of advancing in the desired direction by utilizing only the revolutions of the brushes 14, 14' or 14''. That is, the revolutions of the brushes 14', 14'' provide an advancing force to the body of the cleaner head because of the friction between the floor and the brushes, as well as performing the scrubbing, thereby making it possible to perform the wet-dry sucking.

As described above, according to device of the present invention, the removing of free dirt and the fluid-cleaning are almost simultaneously carried out without using a separate vacuum-suction device and a separate scraper, and therefore, the cleaning efficiency is promoted, as well as maintaining the cleaning efficiency regardless of any direction the cleaner head may be moved.

What is claimed is:

1. A cleaner head connected to a suction source and a cleaning fluid source for cleaning a surface, comprising:

a bottom for movement in proximity to the surface to be cleaned;

a plurality of cleaning fluid spraying nozzles disposed at a central location on the bottom of said cleaner head for delivering the cleaning fluid from the fluid source to the surface to be cleaned;

a first suction nozzle mounted on the bottom of said cleaner head at a first location spaced from the cleaning fluid spraying nozzles and in continuous communication with the surface being cleaned, said first suction nozzle being connected to said suction source;

a first brush in the form of a rotatably driven roller mounted between said cleaning fluid spraying nozzles and said first suction nozzle;

a second suction nozzle mounted on the bottom of said cleaner head at a second location spaced from the cleaning fluid spraying nozzles and in continuous communication with the surface being cleaned, such that said cleaning fluid spraying nozzles are intermediate the first and second suction nozzles, said second suction nozzle being connected to said suction source;

a second brush in the form of a rotatably driven roller mounted between said cleaning fluid spraying nozzles and said second suction nozzle; and a plurality of wheels installed at peripheries of the bottom of said cleaner head for permitting movement of the cleaner head only in directions extending between the first and second suction nozzles, such that one of said first and second suction nozzles and the adjacent brush act on free and solidified dirt prior to the dirt being sprayed by the cleaning fluid spraying nozzles, and such that the other of said first and second brushes and the adjacent suction nozzles sequentially effect a scrubbing of dirt sprayed with the cleaning fluid and a sucking of the scrubbed dirt and cleaning fluid for completely cleaning the surface.

2. The cleaner head as claimed in claim 1, wherein said first and second brushes are made of elastic thick fibers for scraping out solidified dirt.

3. A cleaner head as in claim 1, wherein the wheels are disposed for rotation about parallel axes aligned orthogonally to the direction extending between the first suction nozzle and the second suction nozzle.

4. A cleaner head as in claim 3 wherein the rollers and the wheels are disposed for rotation about parallel axes.

* * * * *